US009121635B2

(12) United States Patent
Mentasti et al.

(10) Patent No.: US 9,121,635 B2
(45) Date of Patent: Sep. 1, 2015

(54) MAGNETIC GASKET FOR REFRIGERATOR CABINETS

(75) Inventors: Mauro Guido Mentasti, Malnate (IT); Roberto Bianchi, Daverio (IT); Marco de Giorgi, Varese (IT); Paolo Cittadini, Luvinate (IT)

(73) Assignee: INDUSTRIE ILPEA S.P.A., Melgesso (IT)

( * ) Notice: Subject to any disclaimer, the term of this patent is extended or adjusted under 35 U.S.C. 154(b) by 0 days.

(21) Appl. No.: 13/991,741

(22) PCT Filed: Dec. 6, 2011

(86) PCT No.: PCT/EP2011/071881

§ 371 (c)(1), (2), (4) Date: Jun. 5, 2013

(87) PCT Pub. No.: WO2012/076509

PCT Pub. Date: Jun. 14, 2012

(65) Prior Publication Data

US 2013/0247472 A1 Sep. 26, 2013

(30) Foreign Application Priority Data

Dec. 10, 2010 (IT) ..... MI2010A002272

(51) Int. Cl.
*F25D 23/08* (2006.01)
*E05C 19/16* (2006.01)

(52) U.S. Cl.
CPC ..... *F25D 23/087* (2013.01); *E05C 19/161* (2013.01)

(58) Field of Classification Search
CPC ..... E05C 19/161; F25D 23/087
USPC ..... 49/475.1, 478.1, 489.1, 493.1
See application file for complete search history.

(56) References Cited

U.S. PATENT DOCUMENTS

| | | | | |
|---|---|---|---|---|
| 5,129,184 | A * | 7/1992 | Fish | 49/478.1 |
| 5,309,680 | A * | 5/1994 | Kiel | 49/478.1 |
| 5,575,485 | A * | 11/1996 | Merla et al. | 277/629 |
| 5,975,661 | A * | 11/1999 | Jeziorowski et al. | 312/296 |
| 6,572,238 | B1 * | 6/2003 | Johnson | 362/145 |
| 8,240,091 | B2 | 8/2012 | Cittadini et al. | |

(Continued)

FOREIGN PATENT DOCUMENTS

| | | |
|---|---|---|
| DE | 10 2005 022515 A1 | 11/2006 |
| DE | 10 2005 043359 A1 | 3/2007 |

(Continued)

OTHER PUBLICATIONS

International Search Report and Written Opinion mailed Feb. 29, 2012 by the European Patent Office (ISA) in underlying counterpart international application No. PCT/EP2011/071881, filed Jun. 12, 2011.

(Continued)

*Primary Examiner* — Katherine Mitchell
*Assistant Examiner* — Catherine A Kelly
(74) *Attorney, Agent, or Firm* — Abelman, Frayne & Schwab

(57) ABSTRACT

Gasket for refrigerator cabinets for providing seal-tight closure between cabinet (32) and door (17) composed of an outer door (30) and inner door (31), comprising a soft bellows portion (11), characterized in that said soft bellows portion (11) is interposed in an extensible manner between at least a pair of magnets (9, 15) one of which is operatively coupled to said door and the other is coupled to said cabinet.

17 Claims, 11 Drawing Sheets

(56) References Cited

U.S. PATENT DOCUMENTS

| | | | | |
|---|---|---|---|---|
| 2005/0076575 | A1 | 4/2005 | Citidini | |
| 2007/0084125 | A1 * | 4/2007 | Gholap et al. | 49/478.1 |
| 2009/0058246 | A1 * | 3/2009 | Cittadini et al. | 312/405 |
| 2009/0314028 | A1 | 12/2009 | Laible | |

FOREIGN PATENT DOCUMENTS

| | | | |
|---|---|---|---|
| EP | 0 146 994 | | 1/1989 |
| EP | 0 319 087 | | 6/1989 |
| EP | 1 129 319 | B2 | 9/2001 |
| EP | 1 466 129 | A1 | 10/2004 |
| EP | 1 869 379 | B1 | 12/2007 |
| JP | 2002 310553 | | 10/2002 |
| WO | WO 00/28267 | | 5/2000 |
| WO | WO 03/048662 | A1 | 6/2003 |
| WO | WO 2006/100220 | A1 | 9/2006 |

OTHER PUBLICATIONS

International Preliminary Report on Patentability completed Jan. 18, 2013 by the International Bureau of WIPO in counterpart international application No. PCT/EP2011/071881, filed Jun. 12, 2011.

* cited by examiner

MAGNETIC GASKET FOR REFRIGERATOR CABINETS

CROSS-REFERENCE TO RELATED APPLICATIONS

This is a 371 of PCT/EP2011/071881, filed Dec. 6, 2011, which claims priority to Italian Application No. MI2010A002272, filed Dec. 10, 2010, the disclosures of which are incorporated herein by reference and made a part of this application.

FIELD OF THE INVENTION

The present invention relates to a gasket for refrigerator cabinets of the kind comprising a soft bellows portion for effecting a seal-tight closure between cabinet and door.

PRIOR ART

The door consists of a shell, defined by an outer door and an inner door, filled with a heat-insulating material, for example polyurethane foam. Suitable gaskets are described for example in EP 146994, EP 319087 and EP 1129319 of the same applicant, in which the gasket is in that case assembled corresponding to said base with outer door and inner door before the step of foaming of the shell, therefore this type of gasket is generally called foamed in place.

On the opposite side relative to the base, the extensible bellows gasket has a magnetic bar which, with the door in the closed position, is coupled by magnetic attraction to the flat face of the edge of the cabinet.

The applicant is also the holder of patents in which a different technique is adopted for assembly of the gasket, press-fitting it in a suitable seat arranged on the shell that is already assembled and foamed, in particular on the inner door. If this seat is formed as a slot on the inner door, this is called push in assembly, for example of the type described in EP 1129319. If this seat is formed as a projection on the inner door, this is called push on assembly, for example of the type described in EP 1466129.

Regarding the foamed in place type, the gaskets of push-in and push-on type have on the one hand the advantages of easier assembly on a door that is already assembled, and of being able to be replaced easily, when worn out, with a spare part, because being a press-fit, they can be removed from the door by an operative merely by pulling, without the aid of mechanical means.

On the other hand the limitations of this technology relate to the difficulties connected with forming of the seat for the gasket on the inner door, whether it is a slot or a projection.

This seat is in fact formed during thermoforming of the inner door, making it difficult to ensure correct dimensional uniformity of this seat on its whole length.

A further complication arises when the assembled outer door/inner door shell is submitted to filling with heat-insulating material, for example by expansion of polyurethane foam. The pressure of the foam, combined with the heat generated by the reaction of expansion, can in fact further deform the seat geometry, whether with a slot or a projection, especially near smaller thicknesses.

In particular for compensating a seat that is often imperfect, gaskets of the push-in and push-on type must therefore have assembly tolerances on dimensions, which we try to reduce for example with a combination of coextruded soft and rigid materials, as in EP 1129319. Nevertheless, the tolerances are still present.

SUMMARY OF THE INVENTION

A first object of the present invention is to preserve, if not improve, a substantial ease of assembly and disassembly of the gasket on a door already assembled, which therefore avoids the foamed in place system, while also avoiding the dimensional problems typical of push-in and push-on systems, whether these relate to the moulding of the gasket seat or to the assembly tolerances.

A further object of the present invention is to provide a gasket with characteristics such that, for meeting the now prevalent requirements on improved thermal insulation for reducing the power consumption of refrigerators, it can be mounted within an outer door/cabinet distance (called hinge height) that is as small as possible. In fact, with less space between the cabinet and the door to be sealed, there is less possibility of heat exchange between the interior of the refrigerator and the outside.

To achieve these objects, and other advantages that will be described hereunder, the present invention proposes a gasket for refrigerators for a seal-tight closure between a refrigerator cabinet and a door composed of an outer door and inner door, comprising a soft bellows portion, characterized in that the gasket comprises at least a pair of magnets one of which is operatively coupled to said door and the other is operatively coupled to said cabinet, said soft bellows portion being interposed in an extensible manner between said magnets.

This extensible bellows gasket therefore comprises at both ends at least one magnetic bar which, with the door in the closed position, is able to be coupled by magnetic attraction to a suitable flat face provided not only on the edge of the cabinet but also on the edge of the door, avoiding the typical structural complications relating to an inner door and outer door mentioned above with respect to the prior art.

The expressions used above "at least a pair of magnets" and "at least one magnetic bar" refer to the possibility of dividing each magnet placed at each end of the soft bellows portion, equivalently, into two or more magnets or magnetic bars side by side.

With the invention it also becomes possible to choose whether to assemble the gasket on the door or on the refrigerator cabinet so that, during door opening, the gasket remains coupled to said door or to the cabinet.

According to the invention, therefore, during door opening one of the two magnets selected to be positioned on the cabinet or on the door, must remain in the coupling position while the other is detached from said coupling, which occurs correspondingly on the door or on the cabinet.

In a preferred embodiment of the invention, this effect is obtained in that the magnet of the pair that is selected to remain in the coupling position exerts a magnetic force of attraction greater than the other, selected for detachment from the coupling position.

In another embodiment, this effect can be obtained with a pair of magnets provided with substantially similar magnetic force of attraction, by arranging on the cabinet or on the door, as selected, a suitable means capable of holding the magnet selected for maintaining the corresponding coupling, for example a channeled seat for receiving a complementary projection provided on the magnet, or, conversely, a suitable projecting constraining means that engages with a complementary groove provided on the magnet.

In a further embodiment a suitable means capable of holding the magnet selected for maintaining said coupling consists of a third magnet of opposite polarity with respect to said magnet selected for maintaining said coupling.

In the embodiment in which, in the coupling position, a magnet m2 exerts a magnetic force of attraction Fm2 (expressed in g/cm) greater than Fm1 of the other magnet m1, where m1 is the magnet selected for detachment from the coupling position during door opening, with the same magnetic material for both magnets a prudent criterion for dimensioning of the two magnets is preferably that Fm2/Fm1 is about 2.

A preferred magnet according to the objects of the invention consists of a flexible bar containing magnetic material, for example ferrite or rare earths, combined with plastic or elastomeric material as binder, to give plastoferrite. The presence of an air gap, given for example by the thickness of the seat of plastic material of the plastoferrite bar provided on the gasket, can affect the force of attraction, so that due account must be taken of this when determining the force of attraction that this magnet must exert. Fm1 is preferably about 20-40 g/cm, more preferably 25-30 g/cm, measured with an air gap of 0.45 mm.

The force of attraction Fm of a magnet according to the invention can be determined and adjusted by varying:

- the magnetic material used, for example isotropic ferrite, anisotropic ferrite, rare earths.
- the type of magnetization, axial or multipolar (dipolar, tripolar, quadripolar, etc). Fm in contact increases as the number of poles is increased.
- the size of the magnet, with identical magnetic material and polarization.

Since a gasket is also subjected to shearing stresses during door opening that imposes a rotation on it, it is preferable that the flat face of the cabinet or of the door on which magnet m2 of the gasket of the invention, i.e. that with the greater force of attraction, must be coupled is laterally delimited by edges for containing any translation by sliding imparted by said shearing stresses.

The gasket of the invention can be produced in a large number of variants. For example in one gasket said bellows portion of soft material is coextruded with a base portion of rigid material consisting of a horizontal section from the end zone of which a pair of vertical sections extend acting as elastically divaricating clips for snap-engaging one magnet of the pair.

In another embodiment, in a gasket of the invention said bellows portion of soft material is coextruded with a base portion of rigid material consisting of a horizontal section, from the end zone of which a pair of vertical sections extend, the resulting C-section acting as a seat for one magnet of the pair formed as a plastoferrite bar coextruded within said C-section, as will be described in greater detail in a later example.

In another embodiment, a gasket of the invention is formed from a single soft plastic material and said bellows portion comprises a base portion that defines a tubular chamber able to contain one magnet of the pair formed as a plastoferrite bar coextruded within said tubular chamber, as will be described in more detail in a later example.

In another embodiment, in a gasket of the invention said bellows portion of soft material comprises a base portion coupled at the bottom to one magnet of the pair by means of an interposed bi-adhesive strip, or a layer of adhesive.

A gasket of the invention preferably comprises further means for maintaining the gap between cabinet and inner door as will be described in more detail in later examples, and preferably as described in EP 1869379 of the same applicant.

BRIEF DESCRIPTION OF THE DRAWINGS

For better understanding of the characteristics and advantages of the invention, non-limiting examples of practical implementation thereof are given below, referring to the diagrams in the appended drawings, in which (except FIG. 2) the gasket of the invention is shown in the operative position when working in conjunction with a refrigerator cabinet and door.

Finally

DESCRIPTION OF THE INVENTION

It should be explained that in all the figures, including those relating to operating positions, for simplicity the gasket is shown schematically according to its nominal section, at rest.

Figure 1:
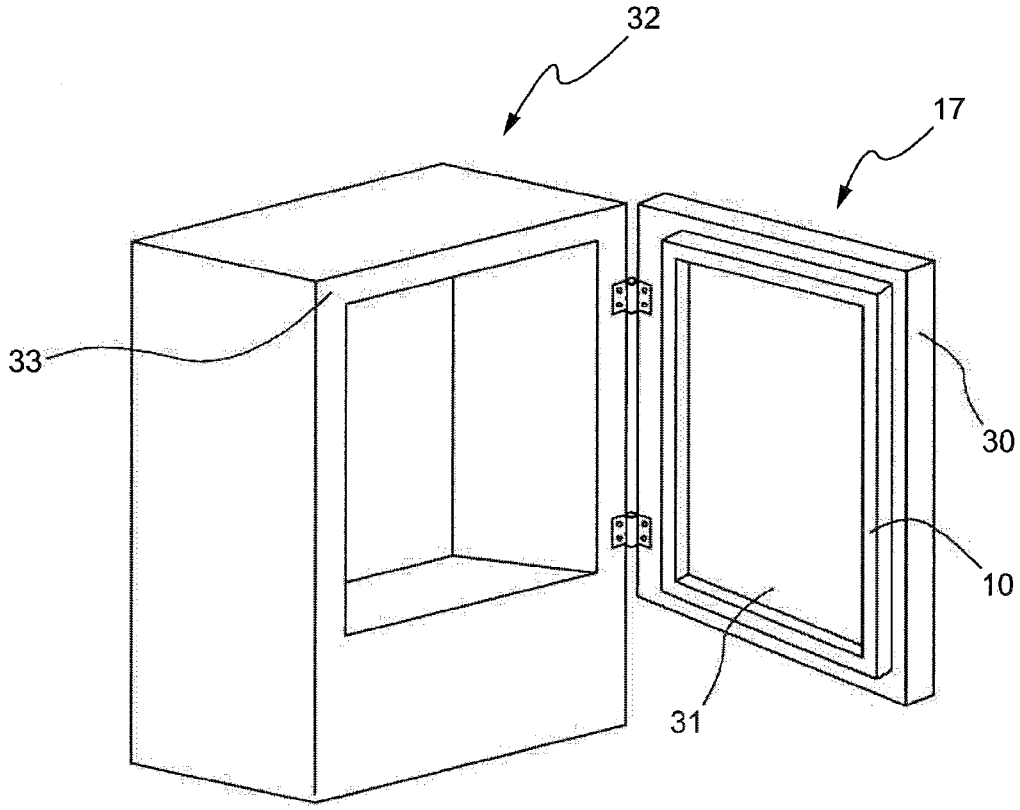
FIG. 1 shows a schematic perspective view of a refrigerator in which the gasket is applied on the door, shown in the open position.

Referring in particular to FIG. 1 of these drawings, a refrigerator comprises a cabinet 32 with an outer edge 33 and a door 17 consisting of outer door 30 and inner door 31, which define a shell filled with heat-insulating material.

Figure 2:
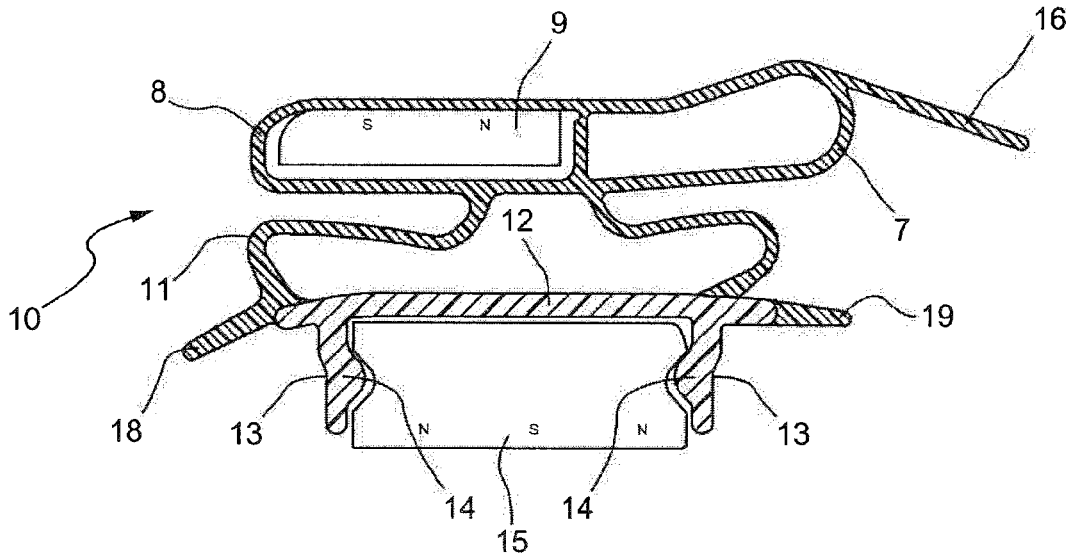
FIG. 2 shows a cross-sectional view of a gasket of the invention.

In FIG. 2, a gasket 10 according to one embodiment of the invention comprises a bellows portion 11 of soft material, for example plasticized PVC or similar, coextruded with a base portion 12 of rigid material such as for example PVC-U (unplasticized, rigid). This base portion 12 consists of a horizontal section from the end zone of which a pair of vertical sections 13 extend, in the direction of the outer door 30, acting as lightly elastically divaricating clips, each shaped with a projection 14 directed towards the interior of the space interposed between them.

The resulting C-section is able to act as a seat for receiving, in a stable manner, a magnet 15, for example consisting of a flexible bar of plastoferrite shaped as a pair of recesses complementary to said projections 14, and snap-engaging therewith by means of clips 13. In the example shown, magnet 15 is tripolar, NSN (North South North).

At the opposite end, the bellows portion 11 terminates at the top with a tubular seat 8 able to contain a second magnet 9, i.e. a strip or bar of magnetic material, in the example consisting of a bipolar SN plastoferrite bar.

Magnet 15 has larger dimensions than magnet 9. Both for this reason and because of the different magnetization, tripolar compared with bipolar, magnet 15 (m2) exerts a greater magnetic force of attraction than magnet 9 (m1), in the example in question the magnetic material of which it is constituted being the same, for example the same type of ferrite.

Figure 3:
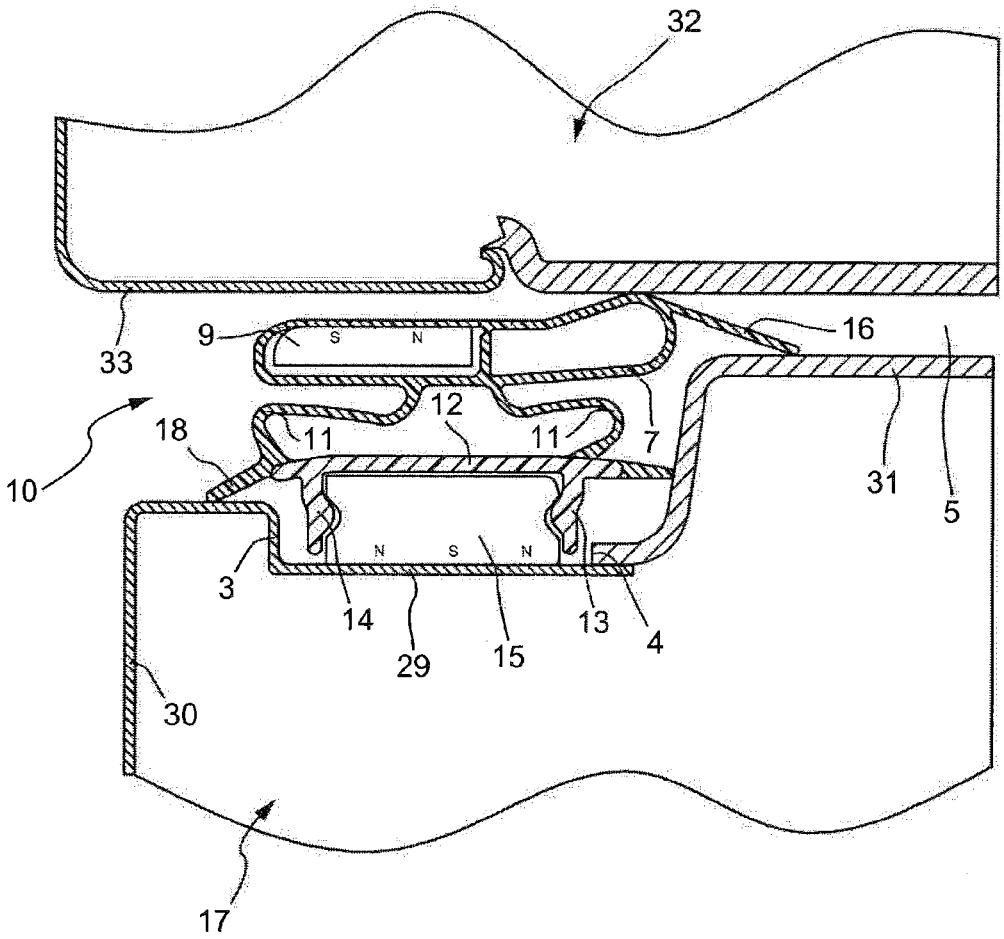
FIG. 3 shows a cross-sectional view of the gasket of FIG. 2 applied in the operating position on the refrigerator, in which the operating position shown is that of door closure.

Referring to FIG. 3, the gasket of FIG. 2 is applied here in the operating position on the refrigerator by coupling of magnet 15 by magnetic attraction to the flat face 29 of the outer door 30 made of sheet metal. Therefore in the operating position of closure in FIG. 2, magnet 9 is coupled by magnetic attraction to the flat edge 33 of cabinet 32 made of sheet metal.

The flat face 29 of outer door 30 in sheet metal to which magnet 15 of the gasket of the invention is coupled is laterally delimited by a step 3 for containing any translation by sliding that might result from the shearing stresses imposed by the rotational movement of the door. On the opposite side, it is edge 4 of the inner door 31 that contains this possible sliding of the base of magnet 15.

Figure 8:
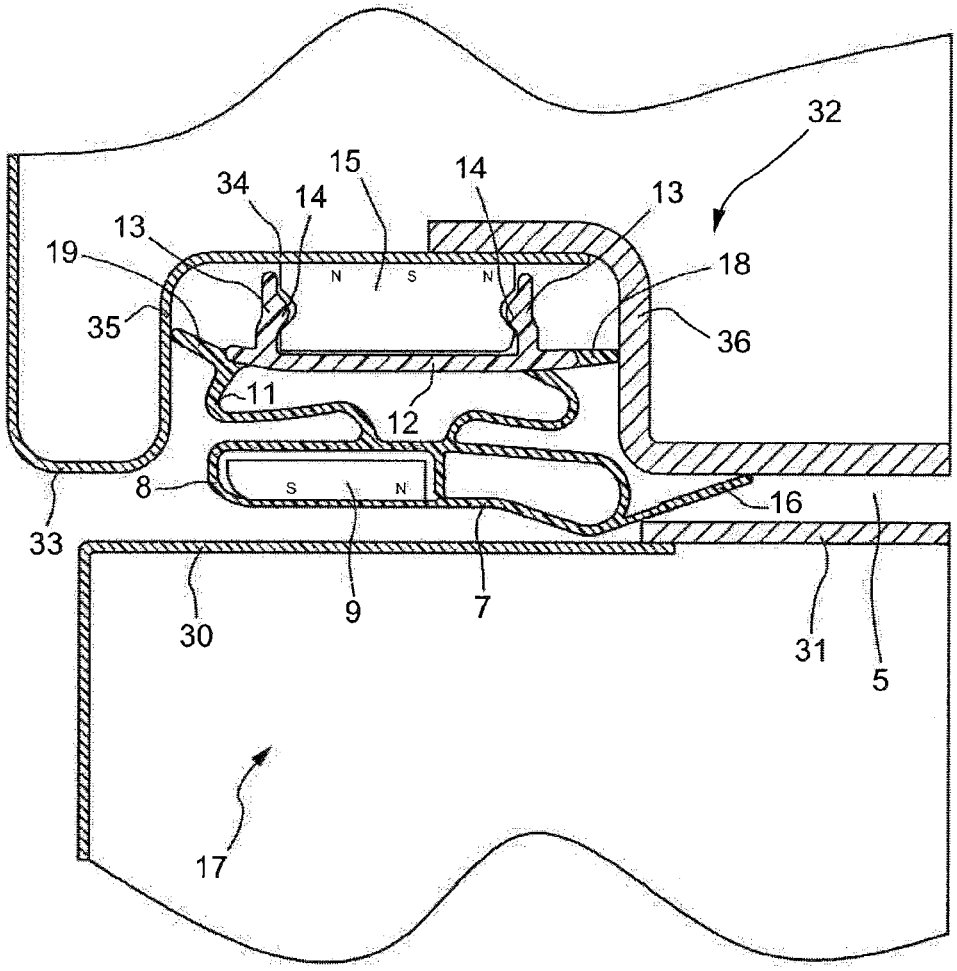

In all the embodiments shown in the drawings, in said bellows portion 11 from said seat 8 of magnet 9, a tubular chamber, or "bulb", 7 for maintaining the gap 5 between cabinet 32 and inner door 31, extends, alongside and towards the internal zone of the refrigerator, and is squeezed in the closed position. Similarly, from the ends of base 12, a pair of lips 18 and 19 extend, for sealing against the supporting wall for which they are intended in the operating position, whether it belongs to the door or to the cabinet (FIGS. 8 and 9).

In the variants in FIGS. 3, 6, 7, 8, 9, a lip 16 extends from said bulb 7, as further element for sealing the gap 5 between cabinet 32 and inner door 31 in the direction of the internal zone of the refrigerator.

Figure 6:
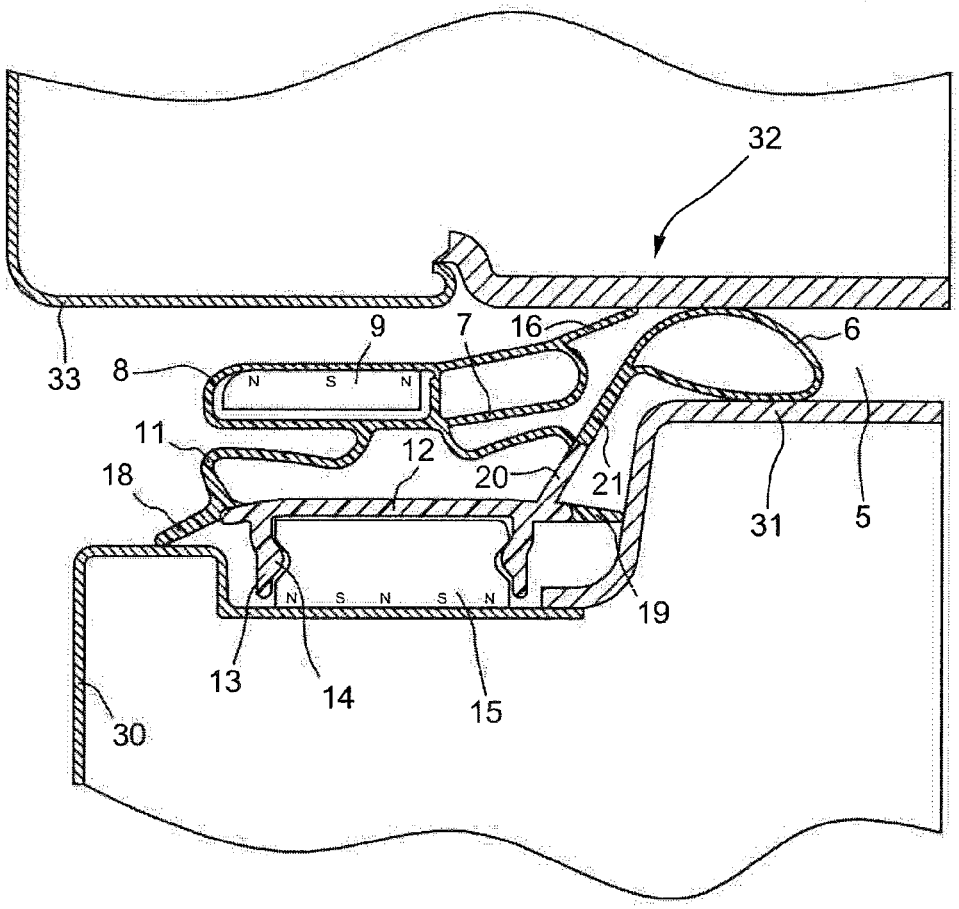
Figure 9:
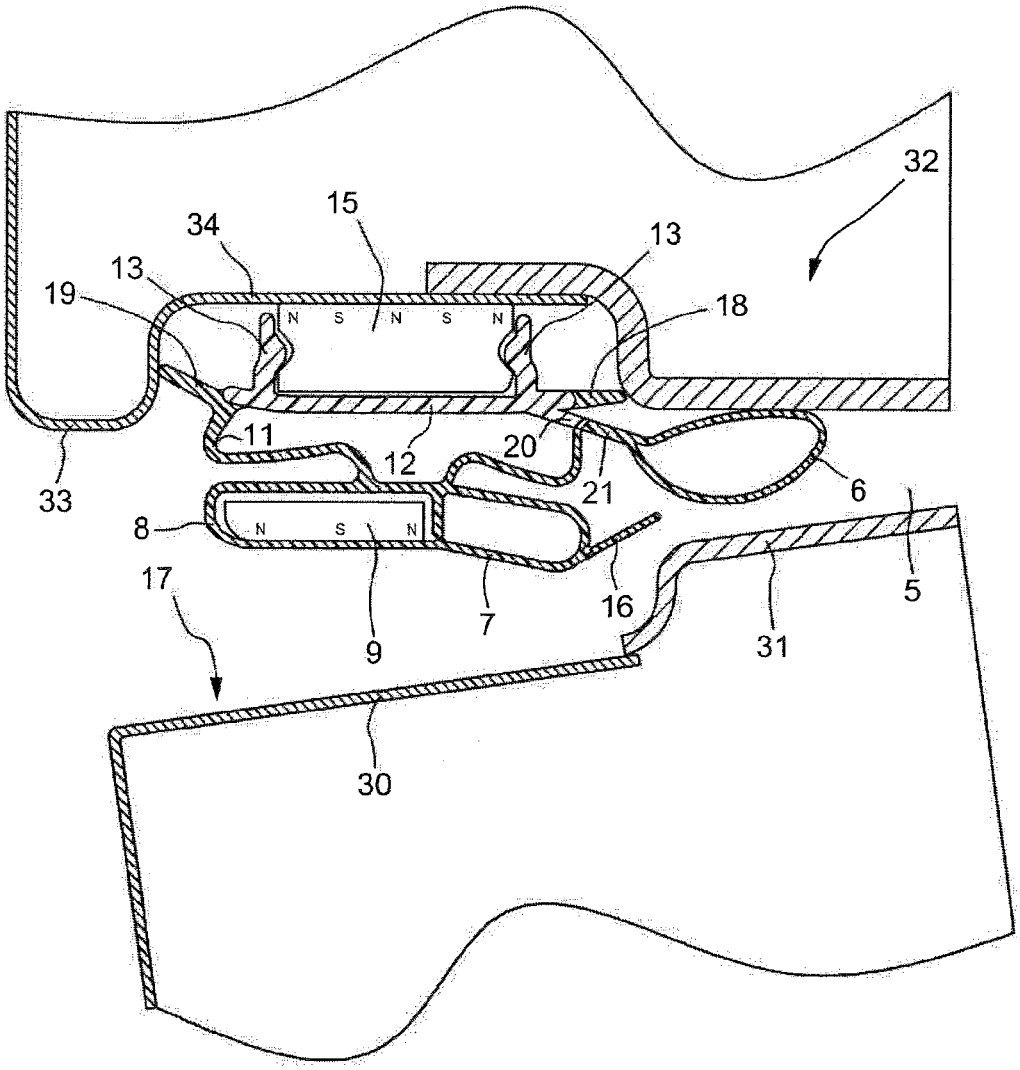
FIG. 9 shows a cross-sectional view of a gasket according to a variant of the invention in the operating position on the refrigerator, in which the operating position shown is that of door opening.

In the variants in FIGS. 6 and 9, as an element for hermetically sealing gap 5 between cabinet 32 and inner door 31 in the direction of the internal zone of the refrigerator, gasket 10 includes a further sealing means 6, as described in EP 1869379 of the same applicant. This is made in the form of a tubular chamber or bulb that extends from an inclined section 20 as termination of the rigid base 12 coextruded with bellows 11, said inclined section 20 being prolonged in a soft section 21, coextruded with said rigid section 20. The bulb 6 constitutes the tubular end of section 21 and has a lengthened section substantially complementary to that of said space 5, so as to be able to seal this space hermetically, being deformed by squeezing on the edge of the cabinet under the action of door closure.

Figure 4:
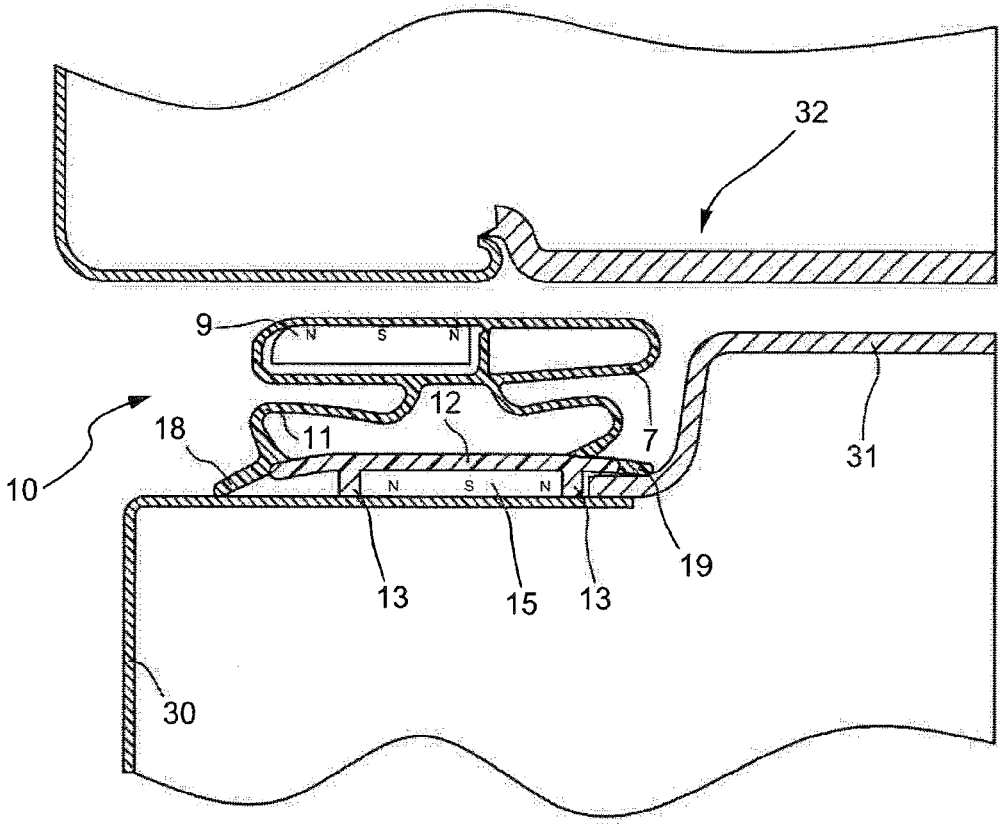
FIGS. 4 to 8, 10 and 11 show similar cross-sectional views of a gasket according to as many variants of the invention applied in the operating position on the refrigerator, in which the operating position shown is that of door closure.

The variant in FIG. 4 shows a gasket 10 with rigid base 12 coextruded with a bellows portion 11 of soft material. The base portion 12 consists of a horizontal section, from the end zone of which a pair of vertical sections 13 extend in the direction of the outer door 30. The resulting C-section acts as a seat for a tripolar (NSN) magnet 15, for example a preformed flexible bar of magnetic material, which during extrusion of the gasket is coextruded with it, or better (being preformed) covered by the C-section of base 12 and sections 13 during passage through the extrusion die for moulding of the gasket.

A suitable rigid plastic material of base 12 can be selected for example from PVC-U, PS or PP, depending on the type of soft material selected for forming the bellows portion 11, for example PVC-P, SEBS or TPO.

The magnet 9 at the opposite end of bellows 11 is a tripolar NSN magnet, for example a flexible bar of plastoferrite inserted in the appropriate tubular seat 8. In this variant, as the polarity of magnets 15 and 9 is the same (NSN) and their dimensions are not substantially different, a greater force of attraction of magnet 15 relative to that of 9 is provided by the nature of the magnetic material used for it, for example a rare earth, a material that is intrinsically capable of exerting a greater magnetic force of attraction than the ferrite used for magnet 9.

Figure 5:
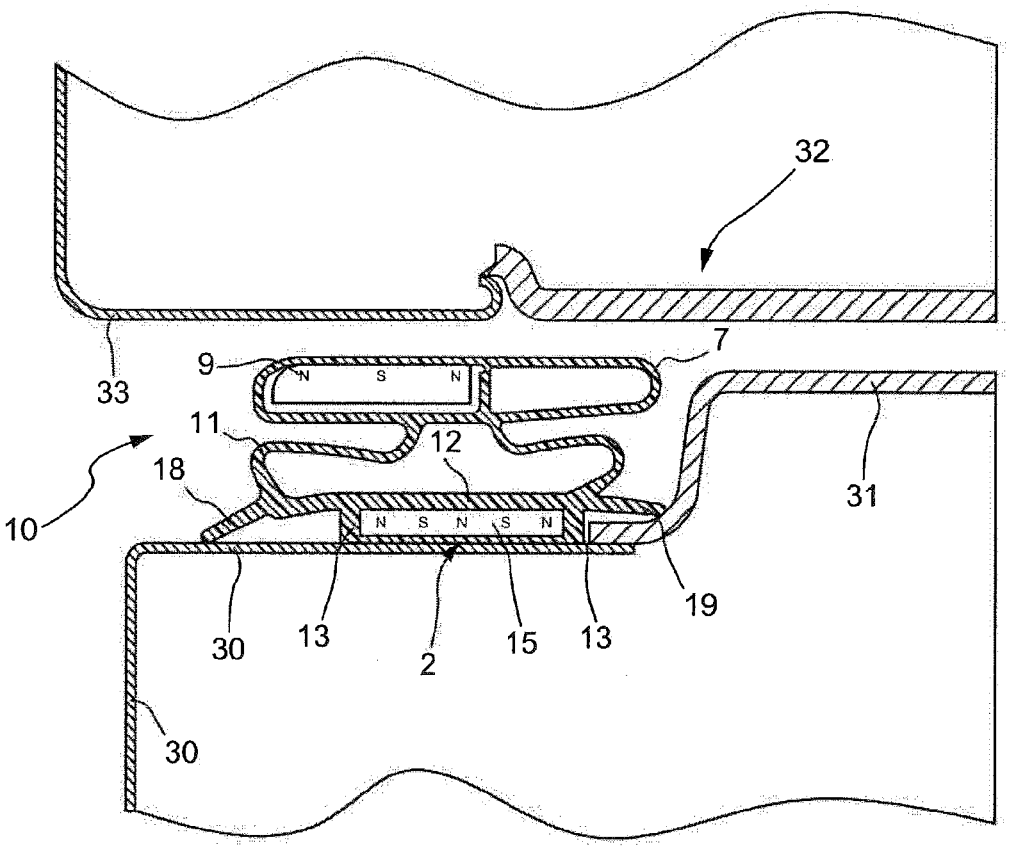

In the variant in FIG. 5, a gasket 10 is made of a single soft plastic material, selected for example from PVC-P, SEBS or TPO. The base portion 12 consists of a horizontal section, from the end zone of which a pair of vertical sections 13 extend in the direction of the outer door 30, and are joined together at the bottom by a horizontal wall. As a result, a tubular chamber is defined, which acts as a seat for a magnet 15. This is a pentapolar NSNSN magnet, for example a preformed flexible bar of plastoferrite, which during extrusion of the soft gasket is coextruded with it, or better (being preformed) is covered by said tubular chamber between 12 and 13 that is defined around it during passage through the extrusion die for moulding the gasket. The magnet 9 at the opposite end of bellows 11 is a tripolar NSN magnet, for example a flexible bar of plastoferrite inserted in a suitable tubular seat 8. In this variant a greater force of attraction in contact with magnet 15 compared to that of 9 is provided by its pentapolarity in contrast with the tripolarity of magnet 9, assuming that both consist of the same ferrite and have dimensions that are not very different.

In the variant in FIG. 6, magnet 15 has larger dimensions than magnet 9. Both for this reason and because of the different magnetization, pentapolar compared to tripolar, magnet 15 exerts a greater magnetic force of attraction than magnet 9, assuming that the magnetic material of which they are constituted is the same, for example the same type of ferrite.

Figure 7:
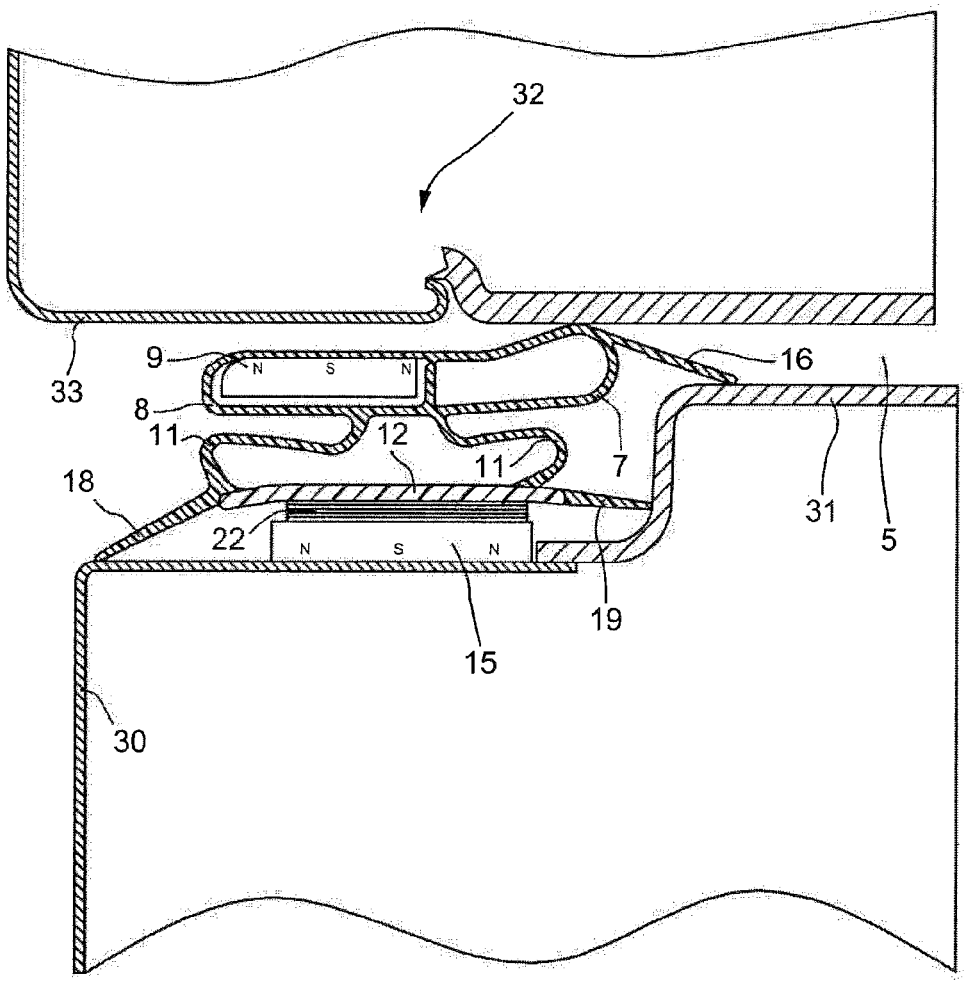

In the variant in FIG. 7, a gasket 10 has similar structure to that of FIG. 2, except that the base portion 12 of rigid material is coupled at the bottom to a magnet 15 by means of an interposed bi-adhesive strip 22.

The magnet 15, for example a flexible bar of magnetic material, is tripolar (NSN). In this embodiment, magnet 9 at the opposite end of bellows 11 is also a tripolar NSN magnet, for example a flexible bar of plastoferrite inserted in a suitable tubular seat 8. In this variant, as the polarity of magnets 15 and 9 is the same (NSN) and their dimensions are not substantially different, a greater force of attraction of magnet 15 than that of 9 is ensured by the nature of the magnetic material used for this, for example an anisotropic ferrite, a material that is intrinsically capable of exerting a greater magnetic force of attraction than the isotropic ferrite used for magnet 9.

FIGS. 8 and 9 show gaskets already described: FIG. 8 shows the same gasket as FIG. 2 (and FIG. 3) while FIG. 9 shows a gasket of a structure that is not identical but is similar to that in FIG. 6. The variants shown here therefore do not refer to the structure per se of gasket 10 but to its operating position. In fact while the variants in FIGS. 3 and 6 show gasket 10 operatively coupled to the door, specifically to the outer door 30, corresponding to magnet 15, which exerts a greater magnetic force of attraction than magnet 9, in the variants in FIGS. 8 and 9 the gasket is operatively coupled to the cabinet 32, preferably to a flat face 34 recessed relative to edge 33, corresponding to magnet 15, which exerts a greater magnetic force of attraction than magnet 9. The flat face 34 to which magnet 15 of the gasket of the invention is coupled is in this case laterally delimited by a pair of steps 35 and 36 forming the edge of cabinet 32 for containing any translation by sliding that might result from the shearing stresses imposed on the gasket by the rotational movement of the door.

This operating position in FIGS. 8 and 9 ensures, during door opening, that gasket 10 remains in the coupling position on cabinet 32, while magnet 9 is detached from the respective coupling on the outer door 30, as identified in FIG. 9.

This situation is opposite to that shown schematically in FIG. 1 and valid for all the operating positions shown from FIG. 3 to FIG. 7, i.e. in which gasket 10 is operatively coupled to the door, specifically to the outer door 30, corresponding to magnet 15 that exerts a greater magnetic force of attraction than magnet 9. In this operating situation, for door opening as shown in FIG. 1, gasket 10 remains in the coupling position on the outer door 30, while magnet 9 is detached from the respective coupling on cabinet 32.

Figure 10:
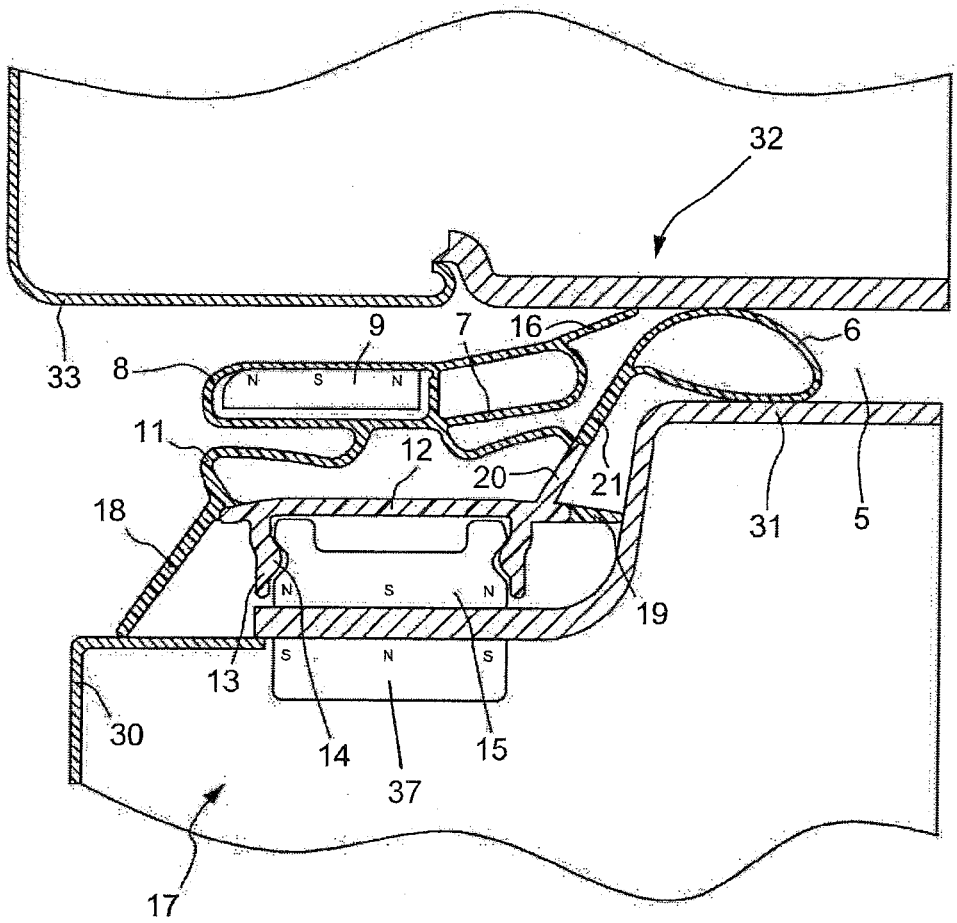

FIG. 10 shows an embodiment of a gasket with structure similar to that of FIG. 6 in which a suitable means capable of holding the magnet 15 selected for maintaining the respective coupling, consists of a third magnet 37 of opposite polarity, SNS, relative to said magnet selected 15, NSN, for maintaining the respective coupling.

In operation, the gasket is in this case applied to a flat face 38 at the end of inner door 31, on which magnet 15 is in fact supported. From the opposite side of 38, thus within the shell of door 17, a magnet 37 is positioned, whose opposite polarity causes an Fm of attraction relative to 15. Therefore in this case Fm of magnet 15 and Fm of magnet 9 can be comparable since detachment of magnet 9 from cabinet 32 during door opening is guaranteed by retention of magnet 15 in position on the inner door by the action of attraction of magnet 37.

Figure 11:
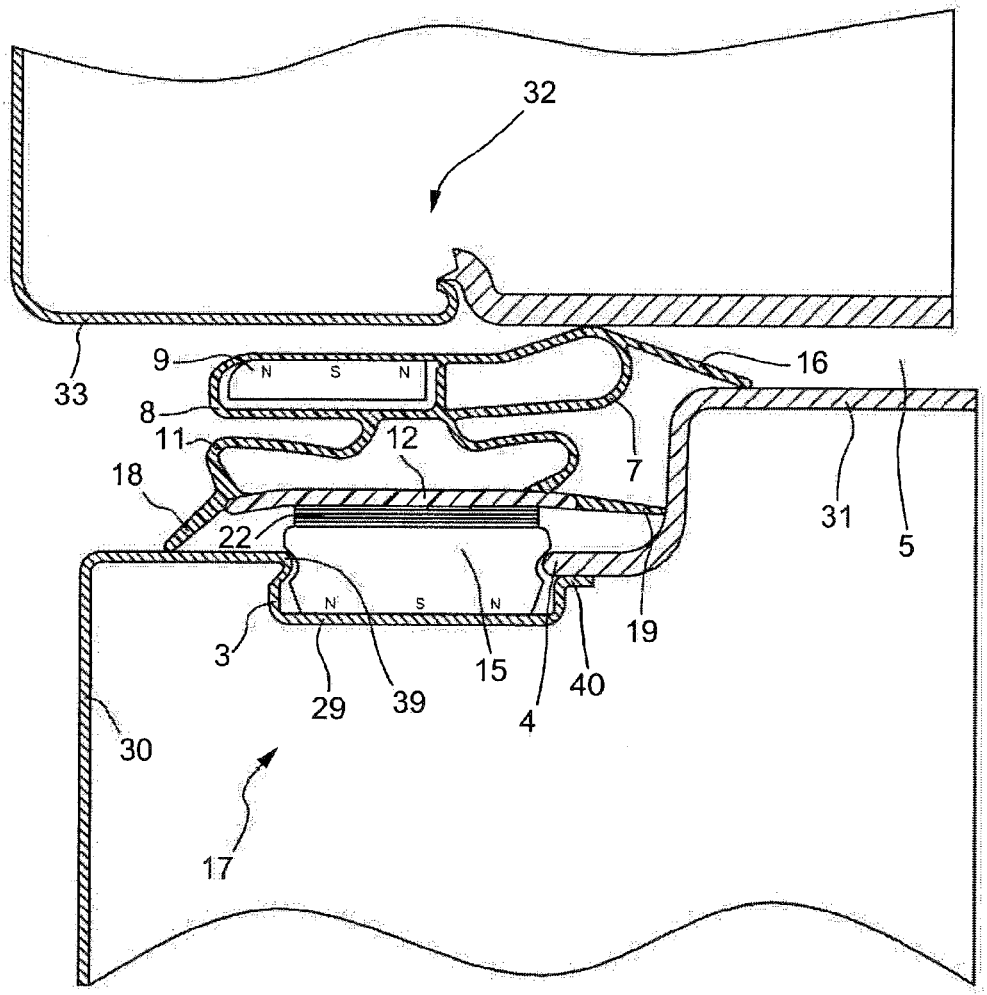

FIG. 11 shows an embodiment of a gasket with structure similar to that of FIG. 7 according to a variant forming the outer door 30 according to a geometry capable of retaining a magnet 15 selected for maintaining respective coupling. In particular, outer door 30 has a flat face 29 recessed by a step 3 formed according to a projection 39 that engages with a complementary groove made in magnet 15. On the opposite side, it is edge 4 of inner door 31 that constitutes a similar projection that engages with a complementary groove made in magnet 15. This edge 4 is supported on a flat end 40 of the outer door 30. Therefore again in this case Fm of magnet 15 and Fm of magnet 9 can be comparable since detachment of magnet 9 from cabinet 32 during door opening is ensured by retention of magnet 15 in position on the inner door by the action of constraints 39 and 4 on magnet 15.

Further variants that can use a pair of magnets 15 and 9 having substantially similar magnetic force of attraction Fm can also be provided for those forms of actuation, similar to FIGS. 6 and 9, that envisage a further sealing means 6 as described in EP 1869379 of the same applicant, formed as a tubular chamber or bulb. In fact 6 is able to exert an elastic force of repulsion opposing the magnetic force of attraction Fm1 of the magnet selected for detachment from the coupling position on the door (or cabinet) during door opening.

Therefore this elastic force of repulsion must be subtracted from Fm1 to evaluate the actual magnetic force of attraction applied during opening. This makes it possible to have Fm1 roughly equal to Fm2, knowing that Fm1 in the operating step of door opening is still lower owing to this effect.

In general, with the present invention, a gasket is therefore obtained which, simultaneously, has a reduced hinge height, improves coverage of the tolerances, and simplifies door manufacture.

It is in fact possible to continue to use the convenient process of thermoforming and foaming of the doors as used typically for foamed in place gaskets, but without encountering the problem of having to assemble the gasket as well, together with the outer door and the inner door at the same time.

Both the inner door and the metallic part of the door, or outer door, can thus be produced more simply by rectilinear flat coupling, without having to check the critical geometry and dimensions for assembly of the gasket.

This results in a greatly reduced scrap rate in production.

Regarding the aforementioned push-in and push-on systems, the invention improves the steps of assembly and replacement, shortening their schedules.

The assembly tolerances of the gasket of the invention will be almost double those of the push-in and push-on kinds.

It thus becomes easy to dismantle and refit the refrigerator gasket, so that this can be done, even just for cleaning the gasket or the cabinet, by the user of the refrigerator, without requiring the services of a maintenance engineer.

The invention claimed is:

1. A gasket (10) for refrigerators for a seal-tight closure between a refrigerator cabinet (32) and a door (17) composed of an outer door (30) and inner door (31), comprising a bellows portion (11), characterized in that said gasket further comprises at least a pair of magnets (9,15), a first magnet of said pair of magnets operatively coupled to said door and a second magnet of said pair of magnets operatively coupled to said cabinet, said bellows portion (11) being interposed in an extensible manner between said magnets, and wherein when opening said door one magnet of said pair of magnets (9,15), remains coupled to said door or said cabinet while another magnet of said pair of magnets is correspondingly detached from said cabinet or said door, respectively, wherein said one magnet can be either said first magnet or said second magnet.

2. The gasket according to claim 1, characterized in that said one magnet of said pair of magnets (9,15) is equipped with constraining means for holding said one magnet on said door or on said cabinet.

3. The gasket according to claim 1, characterized in that said one magnet of said pair of magnets (9,15) exerts a magnetic force of attraction greater than said other magnet.

4. The gasket according to claim 3, characterized in that said greater magnetic force of attraction of said one magnet is about double the magnetic force of attraction of said other magnet.

5. The gasket according to claim 1, characterized in that a size of said one magnet of said pair of magnets (9,15) is greater than a size of said other magnet.

6. The gasket according to claim 1, characterized in that each of said pair of magnets has a different polarization.

7. The gasket according to claim 1, characterized in that each magnet of said pair of magnets is made of a different magnetic material.

8. The gasket according to claim 1, characterized in that said bellows portion (11) is coextruded with a base portion (12) of a material more rigid than said bellows portion, said base portion being comprised of a horizontal section having first and second ends, each said end having a vertical section extending therefrom, said vertical sections dimensioned and configured as elastically divaricating clips which engage said one magnet of said pair of magnets (9,15).

9. The gasket according to claim 1, characterized in that said bellows portion (11) is coextruded with a base portion (12) of a material more rigid than said bellows portion, said base portion being comprised of a horizontal section having first and second ends, each said end having a vertical section extending therefrom to form a C-section therewith, said C-section acting as a seat for said one magnet of said pair of magnets (9,15), said one magnet being made of a plastoferrite bar co-extruded within said C-section.

10. The gasket according to claim 1, characterized in that said gasket is made of a single plastic material and that said bellows portion (11) comprises a base portion (12) that defines a tubular chamber (12, 13) suitable to contain said one magnet of said pair of magnets (9,15), said one magnet being made of a plastoferrite bar coextruded within said tubular chamber.

11. The gasket according to claim 1, characterized in that said bellows portion (11) comprises a base portion (12), a lower side of said base portion (12) being coupled to said one magnet of said pair of magnets (9,15) by an interposed bi-adhesive strip (22).

12. The gasket according to claim 1, characterized in that said bellows portion (11) comprises a base portion (12), a lower side of said base portion (12) being coupled to said one magnet of said pair of magnets (9,15) by an adhesive layer.

13. The gasket according to claim 3, characterized in that said one magnet of said pair of magnets (9,15) which exerts the magnetic force of attraction greater than said other magnet is said first magnet.

14. The gasket according to claim 3, characterized in that said one magnet of said pair of magnets (9,15) which exerts the magnetic force of attraction greater than said other magnet is said second magnet.

15. The gasket according to claim 1, further comprising sealing means for sealing a gap (5) between said cabinet (32) and said inner door (31) when said door is in the closed position.

16. The gasket according to claim 2, wherein said constraining means comprises a third magnet (37) of opposite polarity with respect to one of said pair of magnets (9,15), said third magnet being positioned for holding said one magnet.

17. The gasket according to claim 2, wherein said constraining means for holding said one magnet is provided by configuring said outer door (30) with one flat face (29) which is set back by a recess (3) and conformed with a projection (39), said projection (39) being coupled with a first complementary groove on one side of said one magnet, and, an edge (4) of said inner door (31) includes a corresponding projection dimensioned and positioned to be coupled with a second complementary groove on an opposite side of said one magnet.

* * * * *